US010280645B1

(12) United States Patent
Yang

(10) Patent No.: US 10,280,645 B1
(45) Date of Patent: May 7, 2019

(54) CANOPY FRAME WITH EAVE STRUCTURE

(71) Applicant: Zhejiang Hengfeng Top Leisure Co., Ltd., Wukang Town (CN)

(72) Inventor: Baoqing Yang, HangZhou (CN)

(73) Assignee: Zhejiang Hengfeng Top Leisure Co., Ltd., Zhejiang (CN)

( * ) Notice: Subject to any disclaimer, the term of this patent is extended or adjusted under 35 U.S.C. 154(b) by 0 days.

(21) Appl. No.: 16/003,186

(22) Filed: Jun. 8, 2018

(51) Int. Cl.
*E04H 15/46* (2006.01)
*E04H 15/50* (2006.01)

(52) U.S. Cl.
CPC ..... *E04H 15/46* (2013.01); *E04H 15/50* (2013.01)

(58) Field of Classification Search
CPC ..... E04H 15/44; E04H 15/46; E04H 15/48; E04H 15/50; E04H 15/54
See application file for complete search history.

(56) References Cited

U.S. PATENT DOCUMENTS 6,814,094 B1 11/2004 Barber
7,451,776 B2 11/2008 Chen
7,784,480 B2 8/2010 Sy-Facunda
8,544,489 B2 * 10/2013 Choi ..... E04H 15/50 135/140
8,616,226 B2 12/2013 Ma et al.
8,893,737 B2 11/2014 Yang
9,528,292 B1 12/2016 Lovley, II et al.
9,580,929 B2 2/2017 Ma et al.
9,739,073 B2 * 8/2017 Huang ..... E04H 15/322
9,926,720 B2 * 3/2018 Huang ..... E04H 15/322
2006/0174929 A1 8/2006 Tseng
2007/0051397 A1 * 3/2007 Choi ..... E04H 15/50 135/131
2007/0221262 A1 * 9/2007 Tsai ..... E04H 15/50 135/145
2011/0073148 A1 * 3/2011 Choi ..... E04H 15/50 135/145
2013/0284225 A1 * 10/2013 Holland ..... E04H 15/46 135/139
2014/0174491 A1 6/2014 Yang
2015/0144169 A1 5/2015 Hunt et al.
2015/0376913 A1 * 12/2015 Choi ..... E04H 15/50 135/147

(Continued)

FOREIGN PATENT DOCUMENTS

CN 203742255 U * 7/2014
CN 103410373 B 11/2015

*Primary Examiner* — David R Dunn
*Assistant Examiner* — Danielle Jackson
(74) *Attorney, Agent, or Firm* — Thompson Coburn LLP

(57) ABSTRACT

A canopy has a frame with legs and scissor assemblies. Each leg has fixed and slidable brackets and the scissor assemblies are attached to brackets. The fixed bracket is connected to a roof pole and the slidable bracket is connected to a support pole which is connected to the roof pole. An eave pole is slidably connected with the roof pole and retracts and extends relative to the roof pole. The eave pole is configured to be engaged with the support pole when the frame is expanded. The eave pole is configured to be disengaged from the support pole when the frame is collapsed. The support pole is configured to be releasably locked with the eave pole with the eave pole extended and the frame expanded. The support pole is configured to be disengaged from the eave pole with the frame collapsed thereby allowing the eave pole to retract.

20 Claims, 9 Drawing Sheets

(56) References Cited

U.S. PATENT DOCUMENTS

2016/0108639 A1* 4/2016 Huang ..... E04H 15/322
135/144
2018/0142493 A1* 5/2018 Choi ..... E04H 15/50

* cited by examiner

CANOPY FRAME WITH EAVE STRUCTURE

SUMMARY

The disclosure relates to a canopy with a canopy frame with eave structure that extends the available area of shade under the canopy. The eave structure is formed by extending an eave pole past a leg of a frame of the canopy. The eave pole is slidably connected to a roof pole of the canopy frame and may be adapted and configured to engage a support pole of the canopy frame. When the canopy frame is expanded and the roof pole is moved to a position to expand the canopy frame, the support pole may be moved to position to be engageable with the eave pole when the eave pole is moved to an extended position relative to the roof pole. Thus, when the canopy is expanded and the eave pole is moved to the extended position, the eave pole engages the support pole to releasably lock the eave pole in position relative to the roof pole. When the canopy frame is collapsed and the roof pole is moved to a position to collapse the canopy frame, the support pole is moved to a position spaced from the eave pole. Thus, when the canopy is collapsed, the support pole releases from the eave pole and allows the eave pole to move to a retracted position relative to the roof pole.

DETAILED DESCRIPTION

Figure 1:
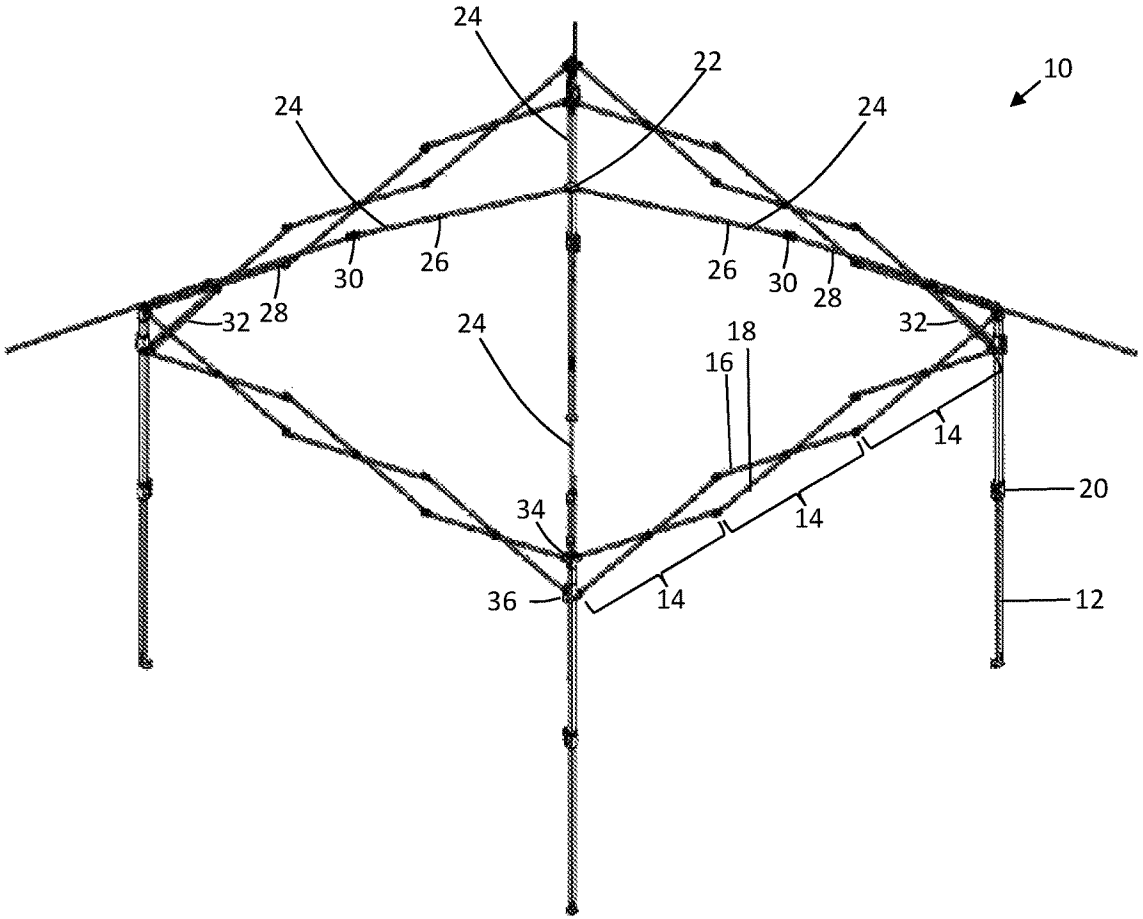
FIG. 1 shows an exemplary canopy frame in an expanded configuration with eave poles of the canopy frame in an extended position.
Figure 2:
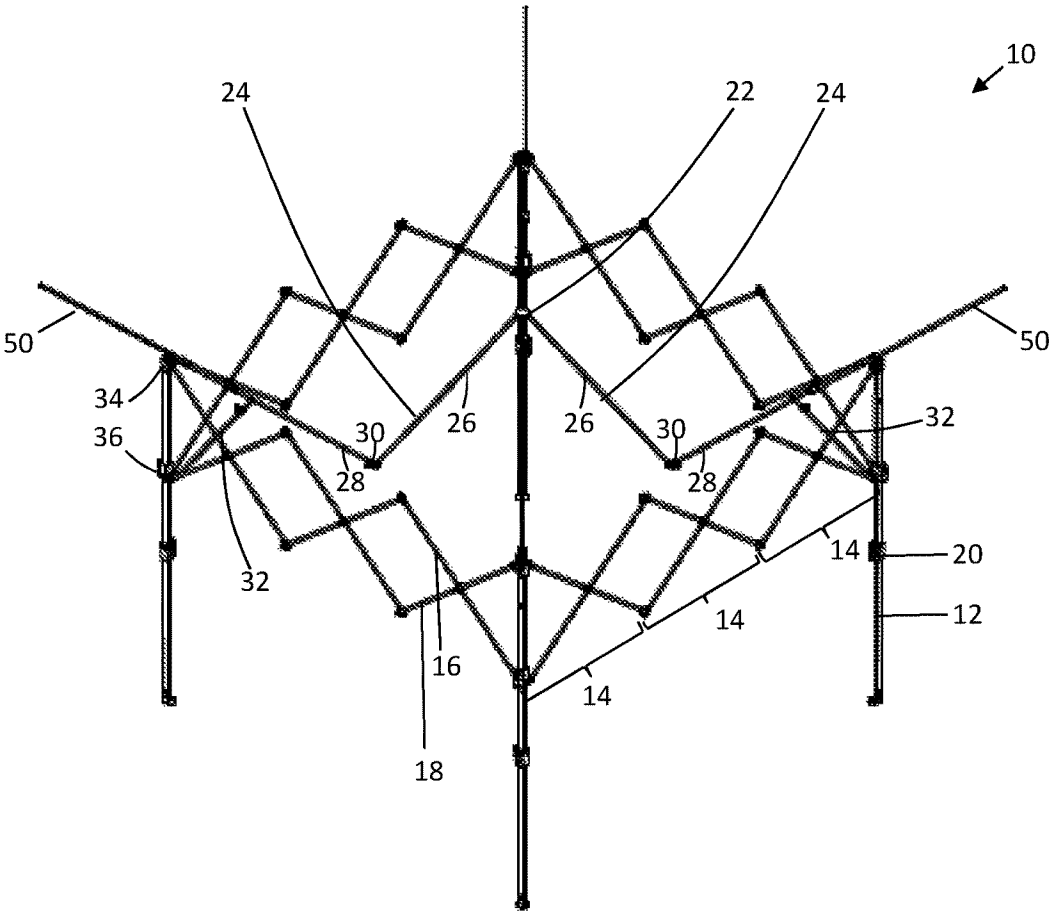
FIG. 2 shows the canopy frame in a partially collapsed configuration.
Figure 3:
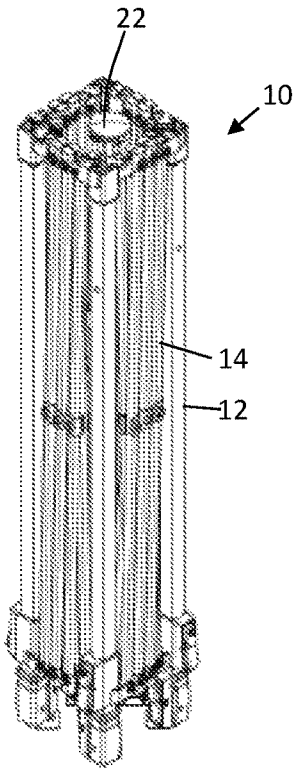
FIG. 3 shows the canopy frame in a fully collapsed configuration.
Figure 4:
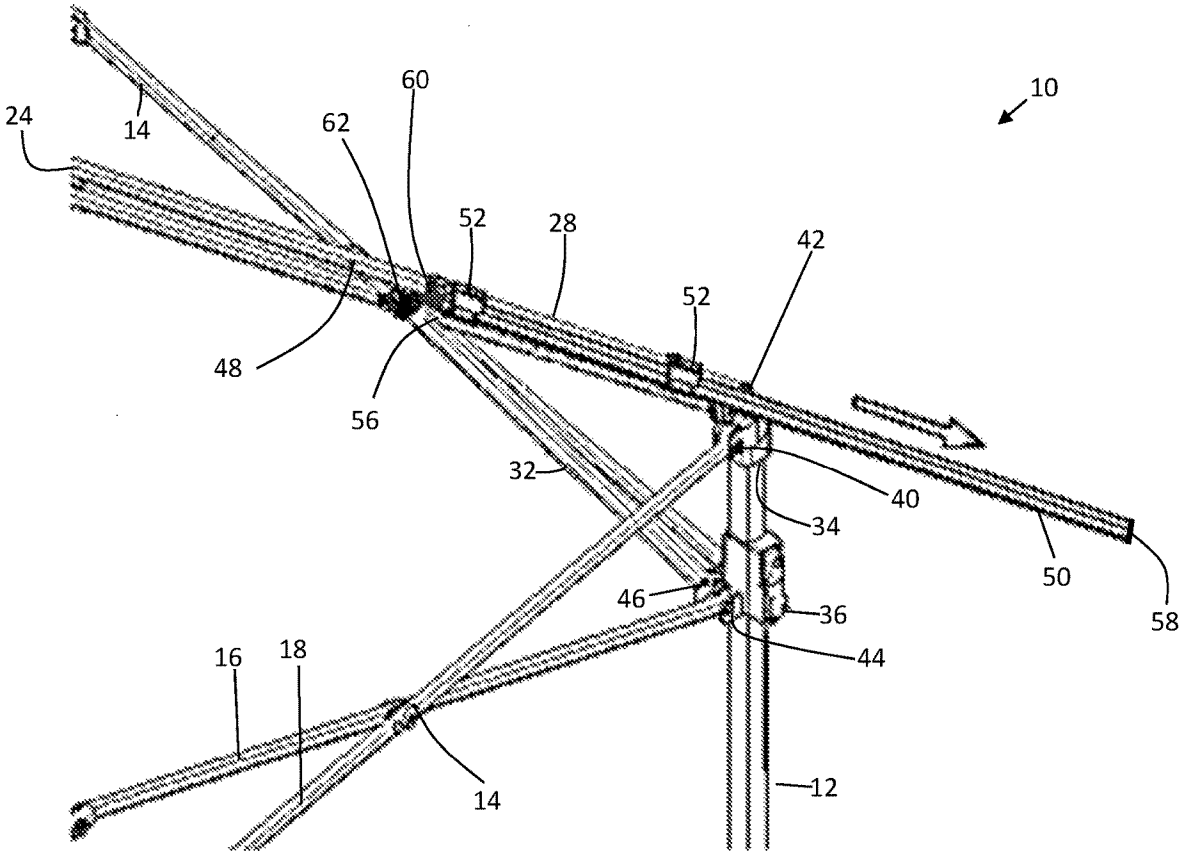
FIG. 4 is a partial perspective view of a corner of the canopy frame and additional detail of a roof pole and scissor assembly connection with a leg of the canopy frame.
Figure 5:
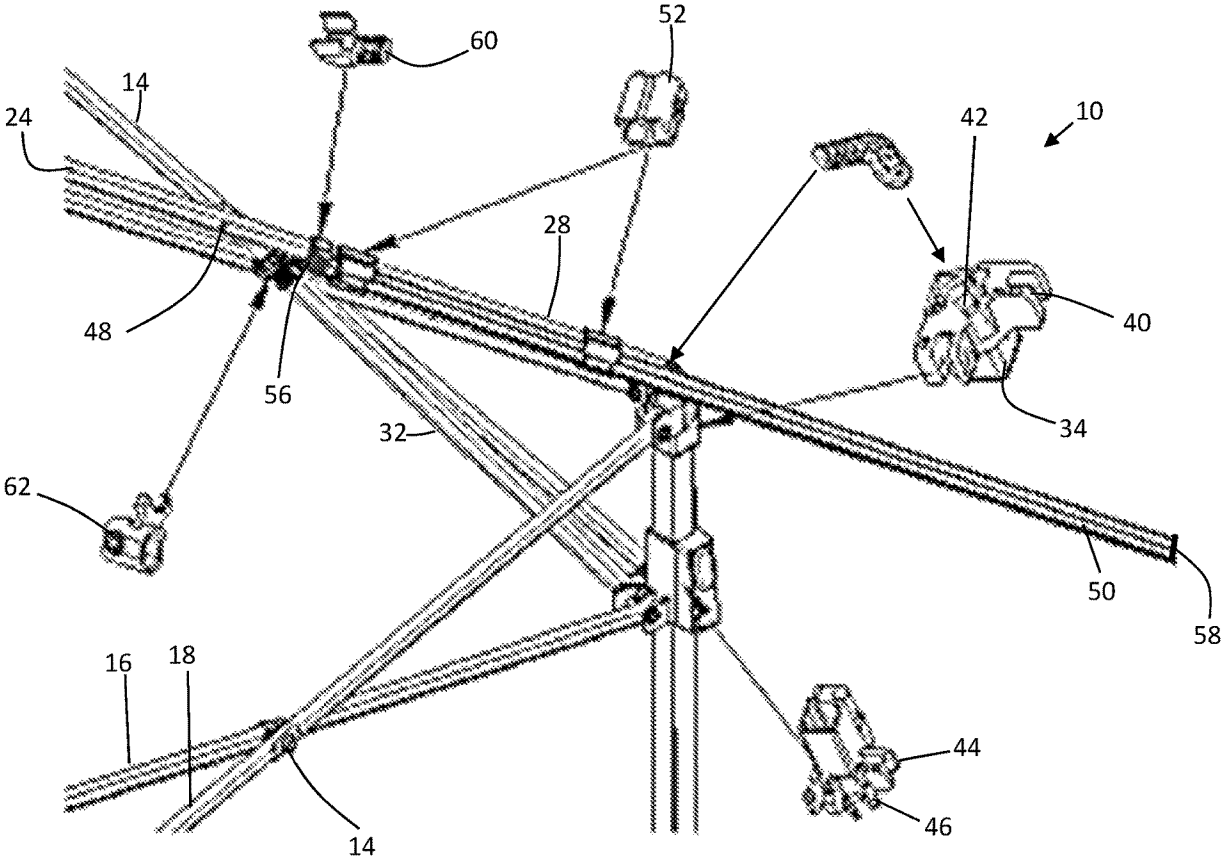
FIG. 5 is a partial perspective view of a corner of the canopy frame providing details of a fixed bracket, a sliding bracket, a roof pole leg connection, sliding couplers, an eave pole tab, and a support pole catch.
Figure 6:
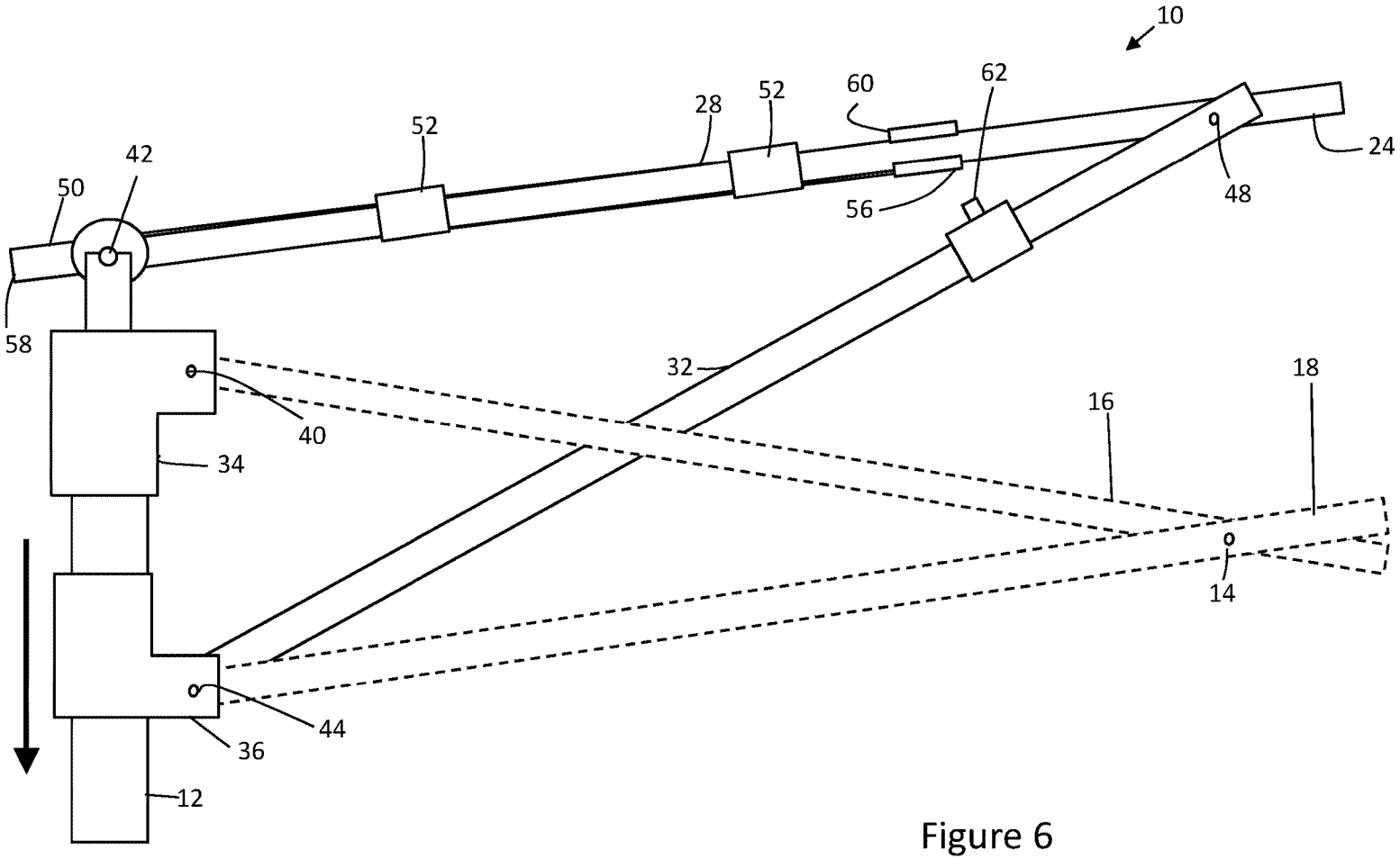
FIG. 6 is a side partial side view of the canopy frame showing the slidable bracket moving away from the fixed bracket so as to pivot the support pole catch away from the roof pole and the eave pole tab.
Figure 7:
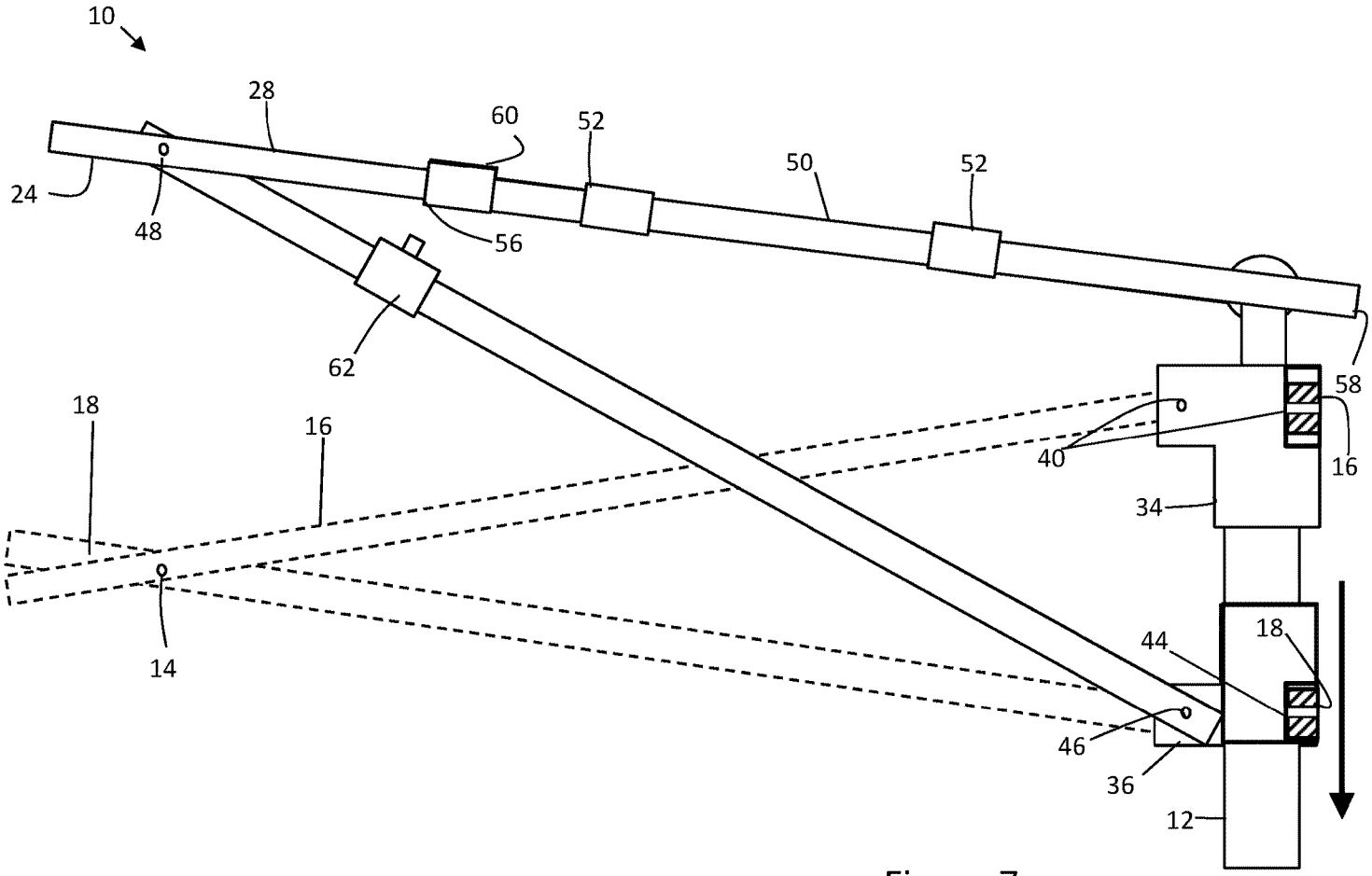
FIG. 7 is a partial side view of the canopy frame opposite the view of FIG. 6.
Figure 8:
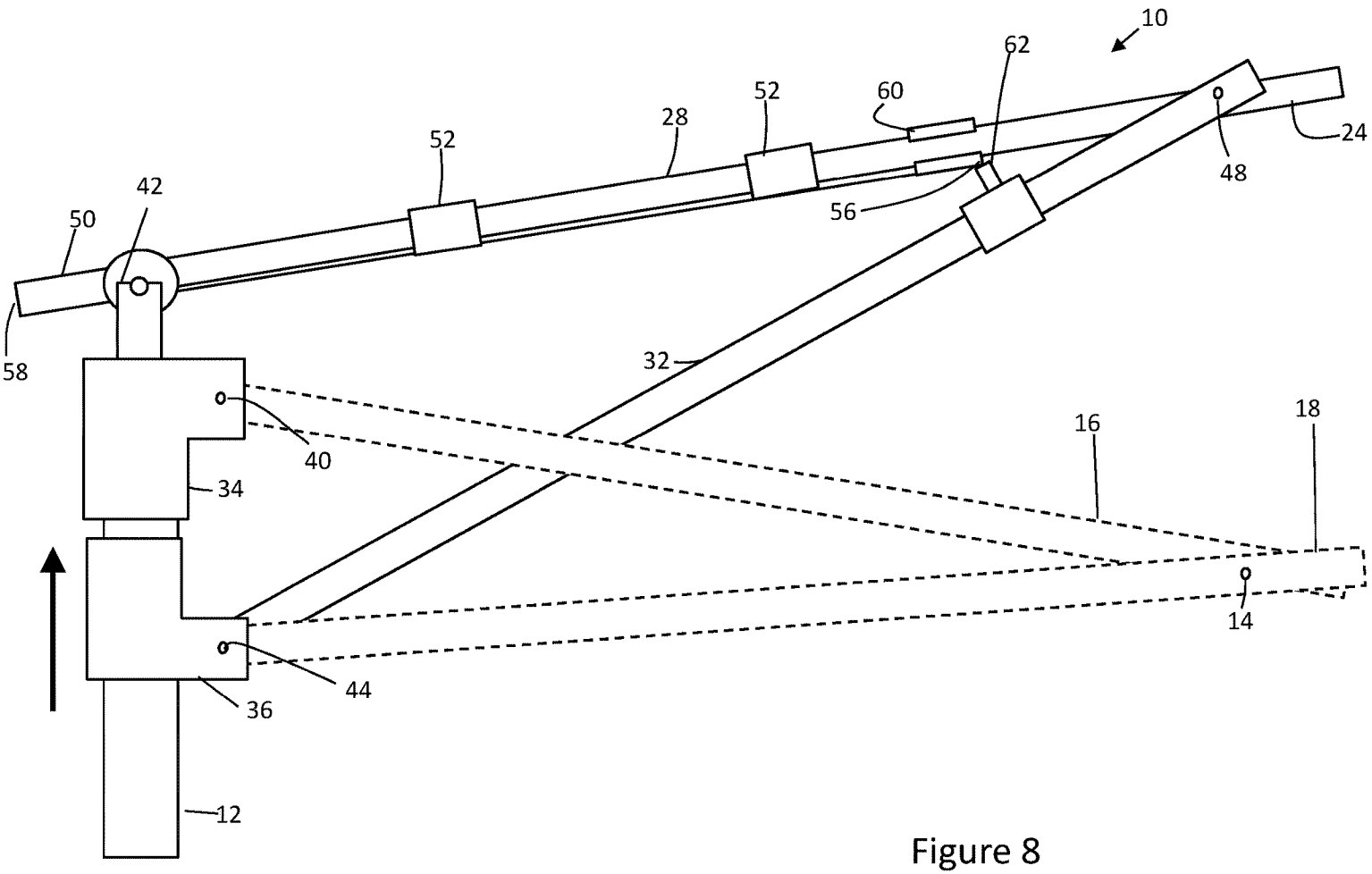
FIG. 8 is a partial side view of the canopy frame showing the slidable bracket being moved toward fixed bracket so as to pivot the support pole catch into a position to engage the eave pole tab.
Figure 9:
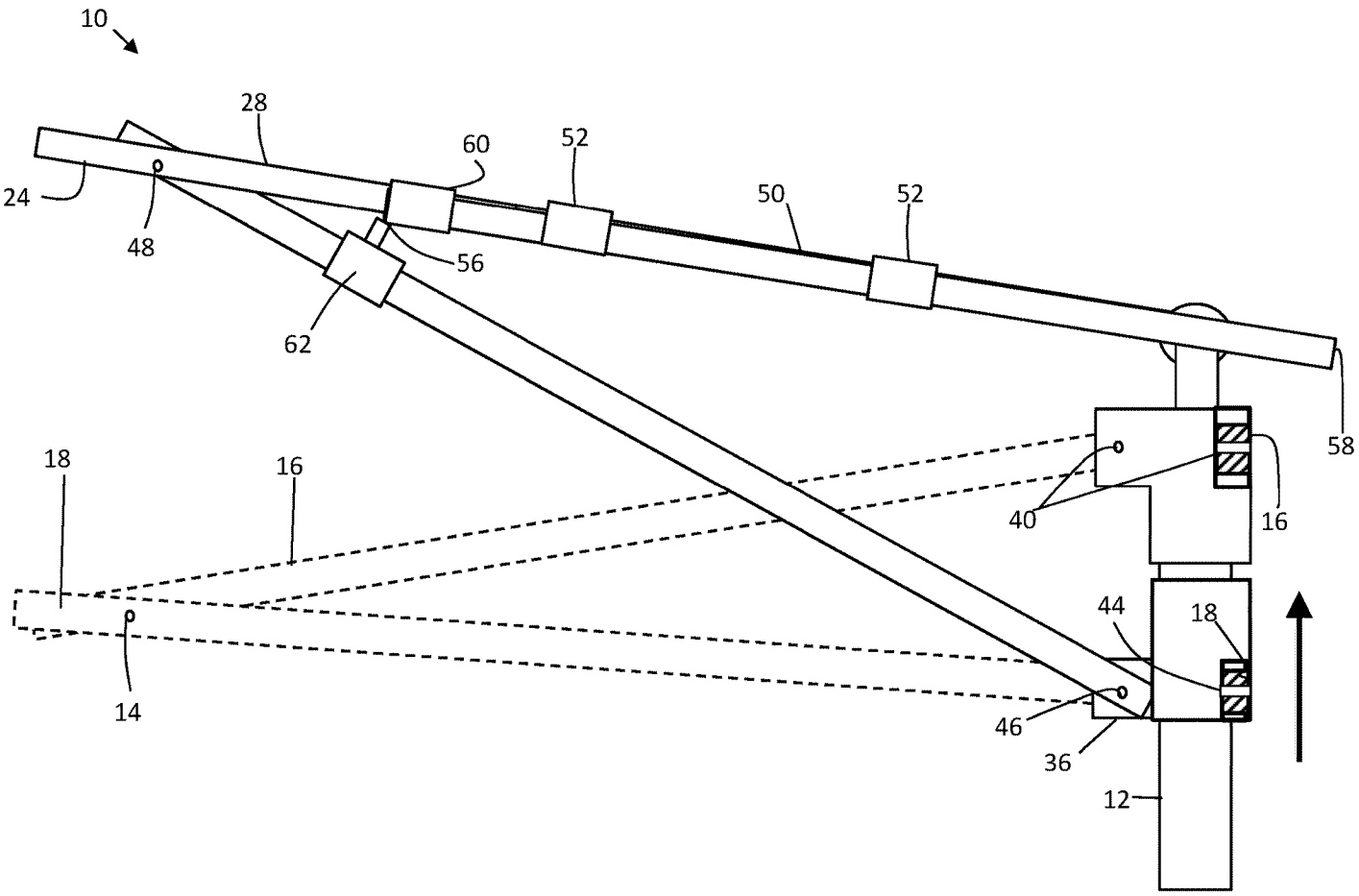
FIG. 9 is a partial side view of the canopy frame opposite the view of FIG. 8.

As shown in the drawings, an exemplary canopy frame 10 has telescoping legs 12 and edge scissor assemblies 14 that extend between the legs. Each of the scissor assemblies 14 is formed of a pair of scissor members 16,18 coupled together and operatively and pivotally connected with the legs 12. The scissor assemblies 14 may extend around the periphery of the canopy frame. There may be more than one scissor assembly 14 extending between the legs of the canopy frame. For instance, as shown in the drawings, there are three scissor assemblies 14 on each side of the canopy frame. Upper and lower ends of each edge scissor assembly may be pivotably coupled to respective upper and lower ends of an adjacent edge scissor assembly. There may also be more than four legs supporting the canopy frame. Each telescoping leg 12 may have a substantially square cross-section and a foot attached at a bottom end of the leg for supporting the weight of the collapsible canopy frame. In one embodiment, each telescoping leg includes two telescoping leg members which may be coupled to each other through a height adjustment bracket 20, which adjusts the relative positions of the upper and lower leg members and therefore the height of each telescoping leg. The height adjustment bracket 20 is conventional. In other embodiments, the legs may not be telescoping, and instead may have a fixed length.

The canopy frame 10 may include a center hub 22 pivotally coupled to a plurality of roof poles 24. The roof poles 24 may have first and second members 26,28 that are pivotally connected to each other with a locking hinge 30. The locking hinge 30 is conventional. The roof pole second member 28 may be operatively pivotally connected with the leg 12. The canopy frame 10 may also include a support pole 32 extending between the roof pole second member 28 and leg 12. A cover (not shown) may extend over the roof poles 24, and the center hub 22, and as described below beyond the scissor assemblies 14 and over eave poles to form an eave for the canopy.

In one exemplary embodiment, each telescoping leg 12 has a fixed bracket 34 and a slidable bracket 36. The fixed bracket 34 may be mounted to the upper distal end of the upper member of the leg 12, and the slidable bracket 36 may be arranged for sliding motion on the upper leg member toward and away from the fixed bracket 34. The slidable bracket 36 may be locked in position on the leg 12 when the frame is expanded. The slidable bracket 36 may be released from engagement on the leg 12 when the frame is collapsed. The fixed bracket 34 may couple an upper end of the member 16,18 scissors assembly 14 to the leg 12, and the slidable bracket 36 may couple a lower end of the member 16,18 of the scissors assembly 14 to the leg. As shown in the drawings, the fixed bracket 34 is positioned on a corner leg 12 and accordingly may have a first pivot connection 40 with the upper end of one scissor assembly on one side of the canopy frame and a second pivot connection arranged perpendicular to the first pivot connection for the upper end of the scissor assembly of the adjoining side of the canopy frame. In an embodiment with multiple legs, the fixed bracket on an intermediate leg between the corner legs may have first and second pivot connections arranged parallel to each other.

The fixed bracket 34 may also have a pivot connection 42 with the roof pole 24. As shown in the drawings, the fixed bracket 34 has a pivot connection with the roof pole second member 28. The fixed bracket roof pole pivot connection 42 is disposed between the first and second upper end scissor assembly pivot connection. When the fixed bracket is disposed on the corner leg in a square or rectangular configuration of the canopy frame, the fixed bracket roof pole pivot connection may be disposed between the first and second upper end scissor assembly pivot connections at 45 degrees. When the fixed bracket is disposed on the intermediate leg in the canopy frame, the fixed bracket roof pole pivot connection may be disposed between the first and second upper end scissor assembly pivot connections at 90 degrees.

As shown in the drawings, the slidable bracket 36 is positionable on a corner leg and accordingly may have a first pivot connection 44 with the lower end of one scissor assembly on one side of the canopy frame and a second pivot connection arranged perpendicular to the first pivot connection for the lower end of the scissor assembly on the adjoining side of the canopy frame. In an embodiment with multiple legs, the slidable bracket on an intermediate leg between the corner legs may have first and second pivot connections arranged parallel to each other for coupling the lower ends of the scissor assemblies to the intermediate leg.

The slidable bracket 36 may also have a pivot connection 46 with the support pole 32 which in turn has a pivot connection 48 with the roof pole 24. As shown in the drawings, the support pole 32 has one end pivotally connected with the slidable bracket 36 and an opposite end pivotally connected with the roof pole second member 28. The slidable bracket support pole pivot connection 46 is disposed between the first and second lower end scissor assembly pivot connection 44. When the slidable bracket 36 is disposed on the corner leg in a square or rectangular configuration of the canopy frame, the slidable bracket support pole pivot connection 46 may be disposed between the first and second lower end scissor assembly pivot connections at 45 degrees. When the slidable bracket is disposed on the intermediate leg in the canopy frame, the slidable bracket support pole pivot connection 46 may be disposed between the first and second lower end scissor assembly pivot connections at 90 degrees.

FIG. 1 illustrates the collapsible canopy frame 10 in a fully opened position. In one embodiment, to expand the canopy frame from a collapsed configuration to the fully expanded configuration shown in FIG. 1, the legs 12 are pulled outwardly at the same time, stretching the canopy frame 10. As the legs 12 are pushed outwardly, the slidable brackets 36 move upward along the legs while scissor members 16,18 rotate relative to one another to reduce the distance between their respective ends, elongating the scissor assemblies. As the slidable brackets 36 move upwardly along their respective legs 12, the support pole 32 (coupled to move with the slidable bracket) also moves upwardly and pushes the roof pole second member 28 upward. As the roof pole second member 28 is pushed upwardly, the roof pole second member 28 and first member 26 may be arranged end to end and locked in place with the locking hinge 30 and moved into a vertical supporting position for tautly supporting the canopy covering (not shown). The slidable bracket 36 may then be releasably locked to the respective leg 12.

To collapse the canopy frame 10, the slidable brackets 36 may be released from their respective legs 12, and the legs may be pushed towards the center of the frame, forcing slidable brackets to move away from fixed brackets 34 as scissor assembly members 16,18 are rotated relative to one another to increase the distance between their respective ends. Meanwhile, the locking hinge 30 connection of the roof pole first and second members 26,28 may be unlocked, and each of the slidable brackets 36 may move downward along the upper member of the legs 12 towards the height adjustment bracket 20 and away from the fixed bracket 34. As the slidable brackets 36 move downwardly, the support poles 32 move down and away from the roof pole second members 28, such that the roof pole second members are rotated to an acutely angled configuration relative to the roof pole first members 26, which in turn drives the center hub 22 downwardly. The roof pole first and second members 26,28 further fold about the locking hinge 30 moving the center hub 22 downwardly with the roof pole first and second members being arranged parallel to each other, and parallel to the support pole 32 and the legs 12. The canopy frame 10 can thus be completely collapsed. Such a collapsed configuration effectively reduces the volume and weight of the canopy frame and allows a user to easily and conveniently carry the canopy frame.

The roof pole 24 may be provided with an eave pole 50 slidingly connected thereto. The eave pole 50 may be arranged with the roof pole 24 in a side by side sliding configuration or a telescopically sliding configuration. As shown in the drawings, the roof pole second member 28 is slidingly connected to the eave pole 50 in a side-by-side arrangement using spaced apart sliding couplers 52. The eave pole 50 may have a proximal end 56 and an opposite distal end 58. The eave pole 50 may be moveable between a retracted position and an extended position. In the retracted position, the eave pole 50 may overlap with the roof pole 24 a first amount, and in the extended position, the eave pole may overlap with the roof pole a second amount which is less than the first amount. When in the retracted position, the eave pole proximal end 56 may be spaced from the connection 42 of the fixed bracket 34 with the distal end of the roof pole 24 a first amount, and when in the extended position, the eave pole proximal end may be spaced from the connection 42 of the fixed bracket 34 with the distal end of the roof pole 24 a second amount which is less than the first amount. Thus, when the eave pole 50 is in the extended position and the frame 10 is in the expanded configuration, the eave pole distal end 58 may engage the canopy covering to form the eave of the canopy cover in an extended position providing more shade under the canopy. The eave pole 50 and the support pole 32 may engage with one another when the frame is in the expanded configuration and may be disengaged with each other when the frame is in the collapsed configuration. By way of example and not in any limiting sense, the eave pole 50 may have an engagement member 60, and the support pole 32 may have an engagement member 62 that cooperates with the eave pole engagement member to allow the eave pole to releasably engage with the support pole. The engagement members 60,62 of the eave pole and support pole may comprise a tab, a motion stop, a catch, a latch, deflecting finger, or any other resilient structure which may allow the eave pole to snap into a releasably locking relationship with the support pole. The eave pole engagement member 60 may be arranged on the proximal end 56 of the eave pole. The support pole engagement member 62 may be arranged adjacent to the pivot connection 48 of the support pole 32 with the roof pole second member 28. Thus, when the canopy is moved to the expanded configuration, the support pole 32 may be pivoted relative to the roof pole second member 28 and/or moved to a position such that the support pole engagement member 62 is engaged with the eave pole engagement member 60 when the eave pole 50 is moved to the extended position. In one embodiment, as the roof pole 24 is moved upwardly and the support pole 32 is moved upwardly into position, the eave pole 50 may slide freely downward under the force of gravity into a position where the eave pole engagement member 60 engages the support pole engagement member 62. The user may then move the eave pole fully to the extended position and releasably lock the eave pole in position with the eave pole engagement member engaged against the support pole engagement member. In another embodiment, the sliding motion of the eave pole relative to the roof pole second member under the force of gravity may be sufficient to fully engage the eave pole engagement member 60 against the support pole engagement member 62.

When the canopy frame 10 is moved to the collapsed configuration, the support pole 32 may be pivoted relative to the roof pole 24 such that the support pole engagement member 62 is spaced away from the eave pole engagement member 60. As the frame 10 is collapsed more and the support pole 32 moves away from the roof pole second member 28, and the roof pool second member 28 pivots downward, that eave pole may freely slide to the retracted position under the force of gravity thereby facilitating the collapsing for the user.

While the drawings show an engagement member comprising tab on the proximal end of the eave pole and an engagement member comprising a catch on the support pole, the features may be reversed on the eave pole and support pole. Additionally, as mentioned above, the catch and the tab may include any other cooperating or interlocking structure sufficient to retain the eave pole in the extended position and allow the eave pole to move to the retracted position with little or no force when the frame is collapsed. In the alternative, the eave pole and support pole may be shaped and/or formed in such a way to be sufficiently interlocking without intermediate structures to allow the eave pole to be retained in the extended position and allow the eave pole to move to the retracted position with little or no force when the frame is collapsed.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A canopy comprising a frame, the frame having a plurality of legs and scissor assemblies extending between the legs, each leg having a fixed bracket and a slidable bracket movable on the leg toward and away from the fixed bracket, respective fixed brackets being operatively pivotally connected to upper ends of respective scissor assemblies of the scissor assemblies, respective slidable brackets being operatively pivotally connected to lower ends of the respective scissor assemblies, the respective fixed brackets being operatively pivotally connected to respective roof poles, the respective slidable brackets being operatively pivotally connected to respective support poles, the respective support poles being pivotally connected to the respective roof poles, the frame being movable between a collapsed configuration and an expanded configuration, wherein in the collapsed configuration, the roof poles, the support poles, the scissor assemblies, and the legs are generally parallel to one another, and wherein in the expanded configuration, the scissor assemblies and the legs are generally perpendicular to each other and the roof poles and support poles extend outward from the legs, the respective roof poles having respective eave poles slidably connected thereto, the eave poles being moveable between a retracted position and an extended position, wherein in the retracted position, the eave poles overlap with the roof poles a first amount, and wherein in the extended position, the eave poles overlap with the roof poles a second amount which is less than the first amount, the eave poles and the support poles each having cooperating engagement members, respective eave pole engagement members being arranged on the respective eave poles such that when the frame is in the expanded configuration, respective support pole engagement members engage the respective eave pole engagement members to releasably lock the eave poles in the extended position, the respective support pole engagement members being arranged on the respective support poles such that when the frame is in the collapsed configuration, the support pole engagement members disengage the eave pole engagement members to enable the eave poles to move to the retracted position.

2. The canopy of claim 1 wherein the eave pole engagement members each comprise a tab.

3. The canopy of claim 1 wherein the support pole engagement members each comprise a catch.

4. The canopy of claim 1 wherein the respective roof poles and the respective eave poles are arranged side-by-side.

5. The canopy of claim 1 wherein the frame has three scissor assemblies disposed between the legs.

6. The canopy of claim 1 wherein the frame has equal sides when the frame is in the expanded configuration.

7. The canopy of claim 1 wherein the legs are disposed on corners of the frame when the frame is in the expanded configuration.

8. A canopy comprising a frame, the frame having a plurality of legs and scissor assemblies extending between the legs, each of the scissor assemblies having first and second members pivotally connected to each other, each leg having a fixed bracket and a slidable bracket movable on the leg toward and away from the fixed bracket, respective fixed brackets being operatively pivotally connected to respective first members of the scissor assemblies, respective slidable brackets being operatively pivotally connected to respective second members of the scissor assemblies, the frame having a plurality of roof poles with opposite distal and proximal ends, the respective fixed brackets being operatively pivotally connected to respective roof pole distal ends, the respective slidable brackets being operatively pivotally connected to respective support poles, the respective support poles being pivotally connected to the respective roof poles, the frame being movable between a collapsed configuration and an expanded configuration, wherein in the collapsed configuration, the roof poles, the support poles, the first and second members of the scissor assemblies, and the legs are generally parallel to another, and wherein in the expanded configuration, the first and second members of the scissor assemblies and the legs are generally perpendicular to each other and the roof poles and support poles extend outward from the legs, the respective roof poles having respective eave poles slidably connected thereto, the eave poles having opposite proximal and distal ends, the eave poles being moveable between a retracted position and an extended position, wherein in the retracted position, respective eave pole proximal ends are spaced from respective fixed bracket connections with the respective roof pole distal ends a first amount, and wherein in the extended position, the respective eave pole proximal ends are spaced from the respective fixed bracket connections with the respective roof pole distal ends a second amount which is less than the first amount, the eave poles having engagement members, the support poles having engagement members, respective support pole engagement members being arranged on the respective support poles such that when the respective roof poles and respective support poles are elevated, the respective support pole engagement members engage the respective eave pole engagement members to releasably lock the eave poles in the extended position, and when the roof poles and support poles are lowered, the respective support pole engagement members are spaced from the respective eave pole engagement members allowing the eave poles to move to the retracted position.

9. The canopy of claim 8, wherein the respective roof poles and the respective eave poles are arranged side-by-side.

10. The canopy of claim 8 wherein the respective roof poles each comprise first and second members pivotally connected together.

11. The canopy of claim 10 wherein respective roof pole second members are operatively connected to the respective support poles and slidingly connected to the respective eave poles.

12. The canopy of claim 10 wherein respective roof pole first members are connected to a center hub.

13. The canopy of claim 10 wherein the respective eave pole engagement members are arranged on the respective eave pole proximal ends.

14. A canopy comprising a frame, the frame having a plurality of legs and scissor assemblies extending between the legs, each leg having a fixed bracket and a slidable bracket movable on the leg toward and away from the fixed bracket, respective fixed brackets being operatively pivotally connected to upper ends of respective scissor assemblies of the scissor assemblies, respective slidable brackets being operatively pivotally connected to lower ends of the respective scissor assemblies, the respective fixed brackets being operatively pivotally connected to respective roof poles, the respective slidable brackets being operatively pivotally connected to respective support poles, the respective support poles being pivotally connected to the respective roof poles, the frame being movable between a collapsed configuration and an expanded configuration, wherein in the collapsed configuration, the roof poles, the support poles, the scissor assemblies, and the legs are generally parallel to another, and wherein in the expanded configuration, the scissor assemblies and the legs are generally perpendicular to each other and the roof poles and support poles extend outward from the legs, the respective roof poles having respective eave poles slidably connected thereto, the eave poles being moveable between a retracted position and an extended position wherein in the retracted position, the eave poles overlap with the roof poles a first amount, and wherein in the extended position, the eave poles overlap with the roof poles a second amount which is less than the first amount, the respective eave poles being adapted and configured to be engaged with the respective support poles when the frame is in the expanded configuration, the respective eave poles being adapted and configured to be disengaged from the respective support poles when the frame is in the collapsed configuration, the respective support poles being adapted and configured to be releasably locked with the respective eave poles with the respective eave poles in the extended position and the frame in the expanded configuration, the respective support poles being adapted and configured to be disengaged from the respective eave poles with the frame in the collapsed configuration thereby allowing the eave poles to move to the retracted position.

15. The canopy of claim 14 wherein the respective roof poles and the respective eave poles are arranged side-by-side.

16. The canopy of claim 14 wherein the respective roof poles each comprise first and second members pivotally connected together, and respective roof pole second members are operatively connected to the respective support poles and slidingly connected to the respective eave poles.

17. The canopy of claim 16 wherein respective roof pole first members are connected to a center hub.

18. The canopy of claim 16 wherein the respective support poles each comprise an engagement member adapted and configured to engage the respective eave poles when the frame is in the expanded configuration.

19. The canopy of claim 16 wherein the respective eave poles each comprise an engagement member adapted and configured to engage the respective support poles when the frame is in the expanded configuration.

20. The canopy of claim 16 wherein the respective eave poles and the respective support poles each comprise engagement members, respective eave pole engagement members being adapted and configured to engage respective support pole engagement members when the frame is in the expanded configuration.

* * * * *